US011149535B2

(12) United States Patent
Brown et al.

(10) Patent No.: US 11,149,535 B2
(45) Date of Patent: Oct. 19, 2021

(54) ELECTRIC SUBMERSIBLE PUMP (ESP) WITH GAS HANDLING SHROUD INLET

(71) Applicant: Halliburton Energy Services, Inc., Houston, TX (US)

(72) Inventors: Donn J. Brown, Broken Arrow, OK (US); Ketankumar Kantilal Sheth, Tulsa, OK (US); Trevor Alan Kopecky, Owasso, OK (US); Casey Laine Newport, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 45 days.

(21) Appl. No.: 16/806,566

(22) Filed: Mar. 2, 2020

(65) Prior Publication Data

US 2021/0270119 A1 Sep. 2, 2021

(51) Int. Cl.

| | |
|---|---|
| ***E21B 43/38*** | (2006.01) |
| ***F04B 47/06*** | (2006.01) |
| ***E21B 43/12*** | (2006.01) |

(52) U.S. Cl.

CPC ..... *E21B 43/38* (2013.01); *E21B 43/128* (2013.01); *F04B 47/06* (2013.01)

(58) Field of Classification Search

CPC ..... E21B 43/13; E21B 43/128; F04B 47/06
See application file for complete search history.

(56) References Cited

U.S. PATENT DOCUMENTS

| | | | | |
|---|---|---|---|---|
| 4,187,912 | A * | 2/1980 | Cramer | E21B 43/38 166/369 |
| 6,382,317 | B1 * | 5/2002 | Cobb | E21B 43/38 166/105.5 |
| 10,378,322 | B2 | 8/2019 | Ejim et al. | |
| 10,408,035 | B2 | 9/2019 | Kennedy et al. | |
| 2002/0153141 | A1 * | 10/2002 | Hartman | E21B 43/128 166/302 |
| 2010/0147514 | A1 | 6/2010 | Swaringin | |
| 2012/0012332 | A1 | 1/2012 | Rooks | |
| 2013/0068455 | A1 * | 3/2013 | Brown | E21B 43/128 166/265 |
| 2016/0130923 | A1 * | 5/2016 | Nowitzki | E21B 43/128 166/66.4 |
| 2017/0081952 | A1 * | 3/2017 | Osborne | E21B 43/38 |

FOREIGN PATENT DOCUMENTS

WO 2017053624 A1 3/2017

OTHER PUBLICATIONS

Foreign Communication from Related Application—International Search Report and Written Opinion of the International Searching Authority, International Application No. PCT/US2020/022038, dated Nov. 27, 2020, 13 pages.

* cited by examiner

*Primary Examiner* — David Carroll
(74) *Attorney, Agent, or Firm* — Conley Rose, P.C.; Rodney B. Carroll

(57) ABSTRACT

An electric submersible pump (ESP) assembly. The ESP assembly comprises an electric motor, a centrifugal pump mechanically coupled to the electric motor, and a gas handling inverted shroud assembly.

20 Claims, 7 Drawing Sheets

ELECTRIC SUBMERSIBLE PUMP (ESP) WITH GAS HANDLING SHROUD INLET

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wells may be drilled to access hydrocarbons pooled in subterranean formations. Sometimes the hydrocarbons may flow naturally to the surface, at least after initially bringing a well on-line after completion. As reservoir pressure drops, however, many wells apply some kind of artificial lift mechanism to assist production of hydrocarbons to the surface. Artificial lift methods comprise electric submersible pumps (ESPs), rod lift, plunger lift, gas lift, charge pumps, and other lift methods. ESPs feature an electric motor powered from an electric power source located at a surface proximate to the wellbore, where the electric motor provides mechanical torque to turn a centrifugal pump. The pump lifts the production fluid to the surface.

Sometimes wells produce reservoir fluid that is a mixture of gas phase fluid and liquid phase fluid. Sometimes gas is initially suspended in the reservoir liquid phase fluid but bubbles out of liquid suspension when the reservoir fluid experiences a pressure drop, for example proximate to a pump intake. Gas can cause a variety of problems for ESPs such as reducing production flow rate and/or causing gas lock. In gas lock, a pump may be filled with gas which may prevent further intake of liquid phase fluid. Additionally, in gas lock the bearings of the pump may rapidly heat up, because the liquid phase fluid that would otherwise lubricate the bearings is missing. When liquid phase fluid then is reintroduced to the pump, the heated bearings may experience thermal shock as they cool rapidly, causing microcracking of the bearing metal, thereby reducing the service life of the ESP.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
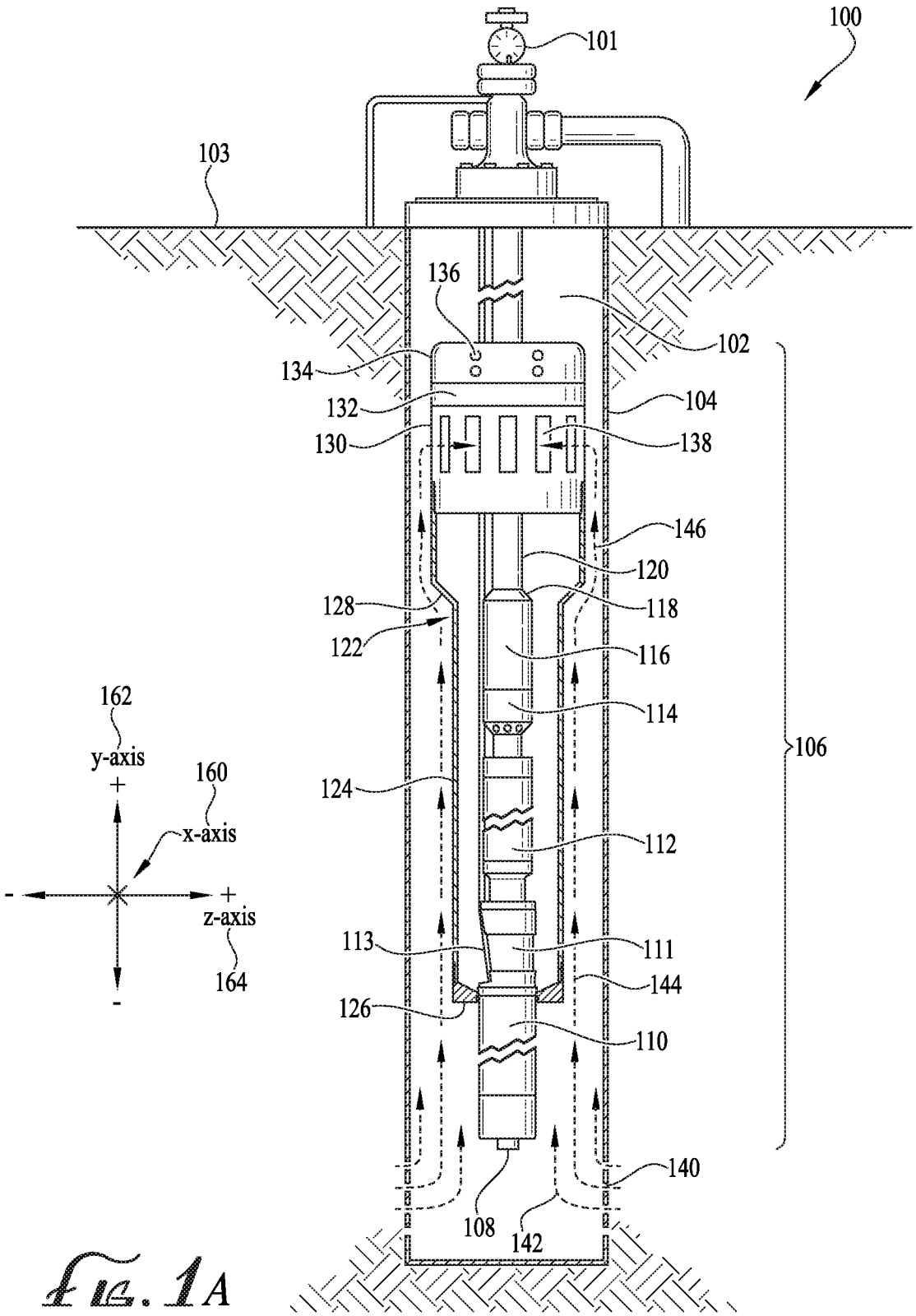
FIG. 1A is an illustration of an exemplary electric submersible pump (ESP) assembly in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

The presence of gas in reservoir fluid entering an electric submersible pump (ESP) assembly can cause a variety of problems. If the gas is mixed with fluid, the aggregate density of the fluid (e.g., the mixture of gas-phase fluid with liquid-phase fluid) may be less than a projected density used when designing the ESP assembly and the ESP assembly may operate inefficiently. If the gas expresses itself as a series of gas slugs, the gas can cause a centrifugal pump of the ESP assembly to become gas locked resulting in lost production and potentially damage to the ESP assembly. Even if the gas slug does not cause the pump to become gas locked, the pump may lose lubrication provided by the liquid, bearings may heat up rapidly, and when liquid reenters the pump, the bearings may experience thermal shock (rapid temperature change) which may cause microcracking of the bearing material and undesirably decrease the service life of the bearings and hence of the ESP assembly. The present disclosure teaches an ESP assembly having a gas handling inverted shroud assembly which passively (e.g., without application of mechanical power from the electric motor to the gas handling features of the inverted shroud assembly) reduces the gas void fraction (GVF) of fluid entering the pump. In an embodiment, the GVF of a fluid may be determined as volume of gas divided by the sum of the volume of gas plus the volume of liquid.

$$GVF = \text{volume of gas}/(\text{volume of gas} + \text{volume of liquid}) \quad \text{EQ 1}$$

In an embodiment, the gas handling inverting shroud assembly comprises a shroud inlet that features directing vanes that induce rotation in the in-flowing reservoir fluid, high GVF fluid concentrates in the center of the annulus formed between an interior of the shroud and an outside of the production tubing and escapes the shroud, and low GVF fluid concentrates at the outside of this annulus enters the pump intake. As used herein a high GVF fluid comprises a higher percentage of gas than the percentage of gas that a low GVF fluid comprises; as used herein a low GVF fluid comprises a lower percentage of gas than the percentage of gas that a high GVF fluid comprises. Said in other words, the terms high GVF fluid and low GVF fluid are relative to each other. In an embodiment, a taper in the wall of the inverting shroud alters the velocity of the reservoir fluid by changing the cross-sectional area of an annulus formed between the interior of a casing and the outside of the inverted shroud, inducing gas suspended in the reservoir fluid to bubble out of liquid suspension and escape upwards before being pulled into the pump inlet. In an embodiment, a clamp portion of the inverted shroud assembly that secures the shroud to the production tubing features gas ports that allow gas that accumulates inside the shroud to escape upwards and avoid being drawn into the pump intake. In an embodiment, these different passive gas handling features can be combined in the same inverted shroud assembly.

Turning now to FIG. 1A, a producing well environment 100 is described. In an embodiment, the environment 100 comprises a wellhead 101 above a wellbore 102 located at the surface 103. A casing 104 is provided within the wellbore 102. FIG. 1A provides a directional reference comprising three coordinate axes—an X-axis 160 where positive displacements along the X-axis 160 are directed into the sheet and negative displacements along the X-axis 160 are directed out of the sheet; a Y-axis 162 where positive displacements along the Y-axis 162 are directed upwards on the sheet and negative displacements along the Y-axis 162 are directed downwards on the sheet; and a Z-axis 164 where positive displacements along the Z-axis 164 are directed rightwards on the sheet and negative displacements along the Z-axis 164 are directed leftwards on the sheet. The Y-axis 162 is about parallel to a central axis of a vertical portion of the wellbore 102

An electric submersible pump (ESP) assembly 106 is deployed within the casing 104 and comprises an optional sensor unit 108, an electric motor 110, a motor head 111, a seal unit 112, an electric power cable 113, a pump intake 114, a centrifugal pump 116, and a pump outlet 118 that couples the pump 116 to a production tubing 120. The motor head 111 couples the electric motor 110 to the seal unit 112. The electric power cable 113 may connect to a source of electric power at the surface 103 and to the electric motor 110. The ESP assembly 106 further comprises an inverted shroud assembly 122. In some contexts, the inverted shroud assembly 122 may be referred to as a gas handling inverted shroud assembly, in reference to the ability of the inverted shroud assembly 122 to reduce the GVF of fluid flowing to the pump intake 114.

In an embodiment, the inverted shroud assembly 122 comprises a seat plate 126, a lower shroud body 124, an outward taper section 128, a shroud inlet 130 defining openings 138, an upper shroud body 132, and a shroud clamp 136. In an embodiment, the seat plate 126 mates sealingly with the motor head 111. In another embodiment, the seat plate 126 mates sealingly with an outside of the electric motor 110 or with an outside of the seal unit 112. The clamp 134 may be secured to the production tubing 120 by bolts located into bolt holes 136.

The casing 104 is pierced by perforations 140, and reservoir fluid 142 flows through the perforations 140 into the wellbore 102. The fluid 142 flows downstream in an annulus formed between the casing 104 and the ESP assembly 106, enters the inverted shroud assembly 122 through openings 138 defined by the shroud inlet 130, reverses direction and flows downwards (in the negative Y-axis direction) in an annulus defined between the interior of the shroud assembly 122 and an exterior of the production tubing 120, the pump 116, and the pump intake 114, is drawn into the pump intake 114, is pumped by the centrifugal pump 116, and is lifted through the production tubing 120 to the wellhead 101 to be produced at the surface 103. While the fluid 142 is inside the shroud assembly 122 gas may break out of the fluid 142 and flow upwards to the shroud clamp 134. In an embodiment, ports or holes in the shroud clamp 134 (discussed further hereinafter) allow the gas to exit the ESP assembly 106 and rise into the wellbore 102 above the ESP assembly 106.

Where the fluid flows upstream of the outward taper section 128, the fluid flow has a first velocity suggested by short fluid arrow 144. When the fluid flows downstream of the outward taper section 128, the fluid flow has a second greater velocity suggested by long arrow 146. The fluid flows more rapidly above the outward taper section 128 because the annulus formed between the inside of the casing 104 and the outside of the ESP assembly 106 has less cross-sectional area downstream of the outward taper section 128 than it has upstream of the outward taper section 128. Not wishing to be bound by theory, it is thought that the increased velocity of fluid 146 is associated with a decrease of pressure of the fluid 146, due to a Venturi effect, relative to the fluid 144 which may promote gas bubbling out of suspension in the fluid 146 and flowing upwards in the wellbore 102 above the ESP assembly 106 outside of the production tubing 120. This gas that is released from fluid 146 is gas that is not drawn into the pump intake 114. Said in other words, the outward taper section 128 can lower the GVF of the fluid that enters the pump intake 114, thereby improving the performance of the centrifugal pump 116.

The outward taper section 128 may be a separate joint of tubular pipe that couples threadedly to a smaller diameter tubular pipe in the lower shroud body 124 at a lower end of the outward taper section 128 and that couples threadedly to a larger diameter tubular pipe in the lower shroud body 124 at an upper end of the outward taper section 128. The location of the outward taper section 128 in the lower shroud body 124 may be varied from a lower end to an upper end of the lower shroud body 124 when assembling the inverted shroud assembly 122 and the ESP assembly 106 at the surface 103 prior to run-in.

In an embodiment, the shroud inlet 130 defines directing vanes which are described further hereinafter with reference to FIG. 3A and FIG. 3B. the directing vanes may impart a rotational motion to the fluid 142 which promotes separating the reservoir fluid 142 into a high GVF fluid located close to the outside of the production tubing 120 in the annulus formed between the inside of the inverted shroud assembly 122 and the outside of the production tubing 120 and a low GVF fluid located close to the outside of the inverted shroud assembly 122. The high GVF fluid may exit the inverted shroud assembly 122, for example via ports or holes in the shroud clamp 134. The low GVF fluid may flow to the pump intake 114 and be pumped by the centrifugal pump 116 via the production tubing 120 to the surface 103.

The inverted shroud assembly 122 may be any length. The inverted shroud assembly 122 may be increased in length or decreased in length by varying the length of the lower shroud body 124 and/or varying the length of the upper shroud body 132. The lower shroud body 124 and the upper shroud body 132 each may be formed of one or more joints of tubular pipe. The joints of the shroud bodies 124, 132 may be threadedly coupled to adjacent parts of the inverted shroud assembly 122. In an embodiment, the ESP assembly 106 may omit the upper shroud body 132 and the shroud inlet 130 may couple directly to the shroud clamp 134. If the inverted shroud assembly 122 is longer it may be capable of storing a greater volume of reservoir fluid 142 and therefore may be more capable of riding through larger gas slugs before the store of fluid is depleted and gas intrudes into the pump intake 114. In an embodiment that comprises the upper shroud body 132, the upper shroud body 132 may provide a point for gas, gas bubbles, or high GVF fluid to escape the interior of the inverted shroud assembly 122 without being recirculated.

The centrifugal pump 116 may be a multi-stage pump comprising a set of rotating impellers and corresponding stationary diffusers. In an embodiment, the ESP assembly 106 may comprise a plurality of separate centrifugal pumps 116 ganged together. The seal unit 112 may protect the electric motor 110 from infiltration of reservoir fluid 142 into the interior of the electric motor 110. As depicted in FIG. 1A, the electric motor 110 may be located outside of and upstream of the inverted shroud assembly 122 whereby the electric motor 110 can receive the cooling benefits of the flow of reservoir fluid 142. In another embodiment, however, the electric motor 110 may be located within the inverted shroud assembly 122, and recirculation tubes may direct reservoir fluid deviated from the pump outlet 118 to the area of the electric motor 110 to provide cooling flow.

It is noted that the transition of reservoir fluid 142 flowing in the annulus between the inside of the casing 104 and the outside of the inverted shroud assembly 122 to reservoir fluid 142 flowing in the annulus between the inside of the inverted shroud assembly 122 and the outside of the production tubing 120 may result in a substantial reduction in flow velocity of the reservoir fluid 142 above the centrifugal pump 116. This is a result, to some extent, of the smaller diameter of the production tubing 120 versus the relatively larger diameter of the centrifugal pump 116. This reduced flow velocity can promote the rising of gas bubbles in the reservoir fluid 142 and escape of the gas bubbles through the shroud clamp 134. If the reservoir fluid 142, by contrast, were flowing at a higher velocity, the gas bubbles might then be entrained and carried along with the liquid phase fluid against its normal tendency to rise and to enter the pump intake 114.

Figure 1B:
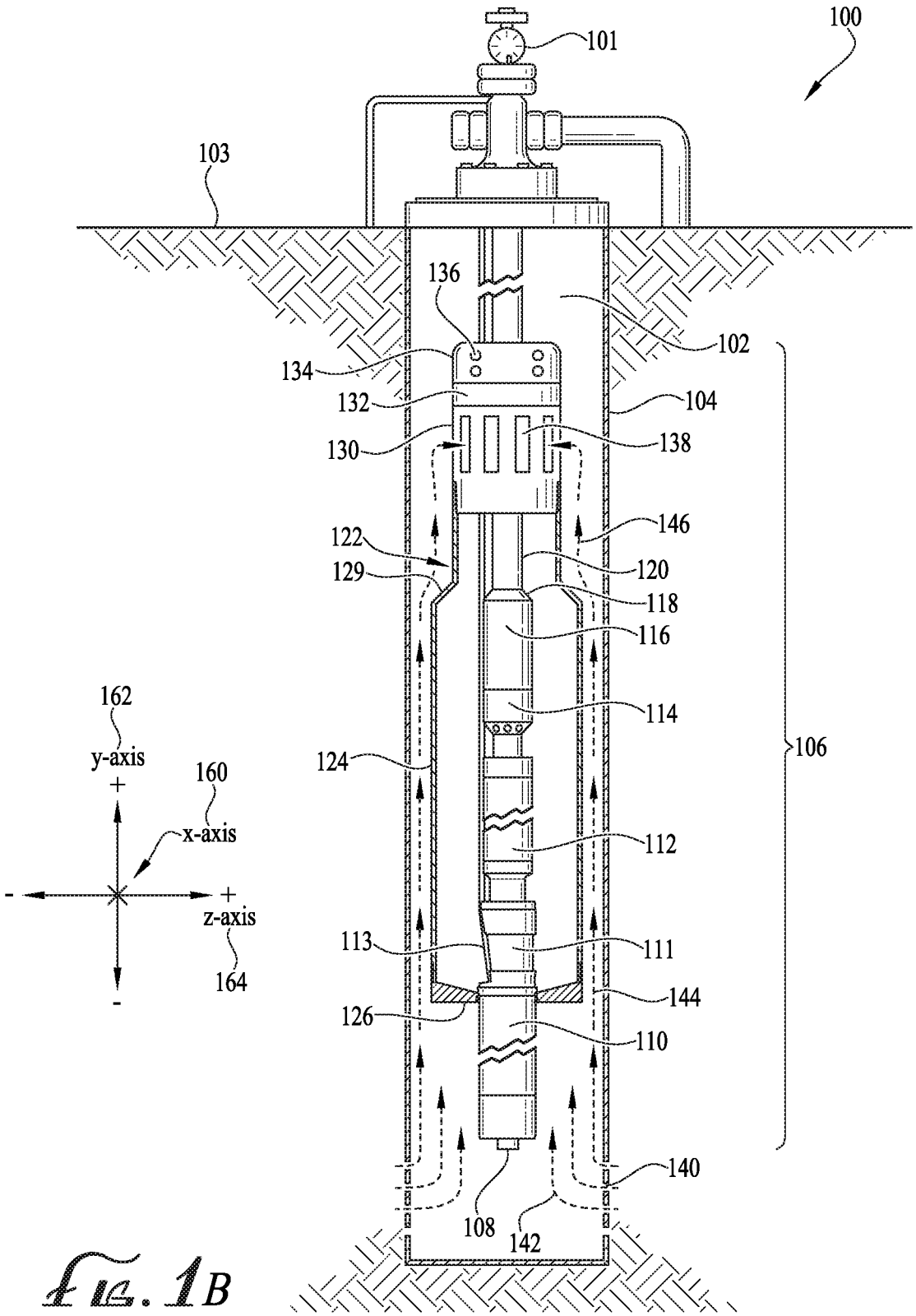
FIG. 1B is an illustration of another exemplary ESP assembly in a wellbore according to an embodiment of the disclosure.

Turning now to FIG. 1B, an alternative embodiment of the ESP assembly 106 is described. In FIG. 1B, the outward taper section 128 of FIG. 1A is replaced with an inward taper section 129. As the reservoir fluid 142 passes downstream above the electric motor 110 the fluid velocity increases in the annulus formed between the casing 104 and the lower shroud body 124 because the cross-sectional area of this annulus is less than upstream of the seat plate 126. This increased velocity may create a Venturi effect, causing a reduced pressure in the reservoir fluid 142 in the annulus between the casing 104 and the lower shroud body 124. The reduced pressure may promote gas in suspension in the reservoir fluid 142 bubbling out of suspension. The inward taper section 129 may be a separate joint of tubular pipe that couples threadedly to a larger diameter tubular pipe in the lower shroud body 124 at a lower end of the inward taper section 129 and that couples threadedly to a smaller diameter tubular pipe in the lower shroud body 124 at an upper end of the inward taper section 129. The location of the inward taper section 129 in the lower shroud body 124 may be varied from a lower end to an upper end of the lower shroud body 124 when assembling the inverted shroud assembly 122 and the ESP assembly 106 at the surface 103 prior to run-in.

As the reservoir fluid 142, (now comprising some free gas separated from the liquid-phase fluid, passes downstream of the inward taper section 129, the cross-sectional area of the annulus between the casing and the lower shroud body 124 increases, the fluid velocity decreases. This decreased fluid velocity may encourage the free gas to rise beyond the shroud inlet 130 and escape to the wellbore 102 above the ESP assembly 106 rather than be entrained (as it might by fluid having a higher flow rate) and drawn into the interior of the inverted shroud assembly 122. This results in the reservoir fluid 142 entering the shroud inlet 130 and being drawn in by the pump intake 114 having a lower GVF. It is understood that the gas handling functions associated with the directing vanes of the shroud inlet 130 and the gas ports of the shroud clamp 134 may contribute to further reducing the gas-to-fluid ratio of the reservoir fluid 142 inside the inverted shroud assembly 122. Said in other words, when used in combination, the gas handling features of the inward taper section 129, of the directing vanes of the shroud inlet 130, and of the gas ports in the shroud clamp 134 may be combined in the same ESP assembly 106 to collaborate in reducing the GVF of the reservoir fluid 142 before it reaches the pump intake 114.

Figure 2A:
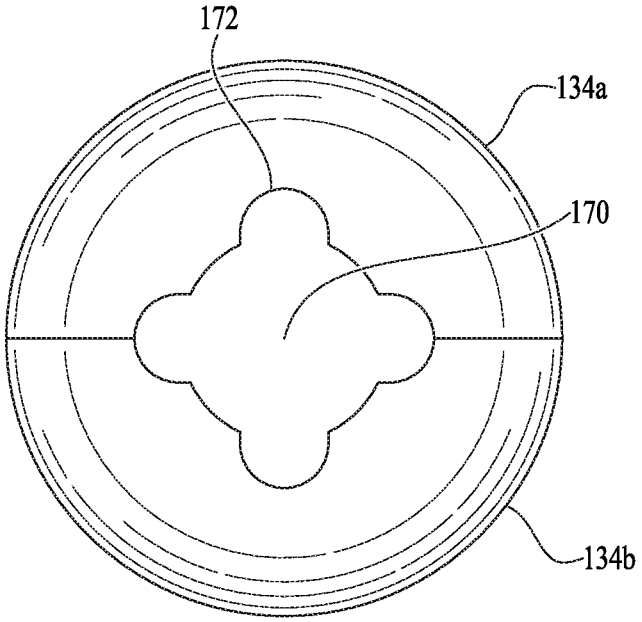
FIG. 2A is an illustration of a shroud clamp according to an embodiment of the disclosure.
Figure 2B:
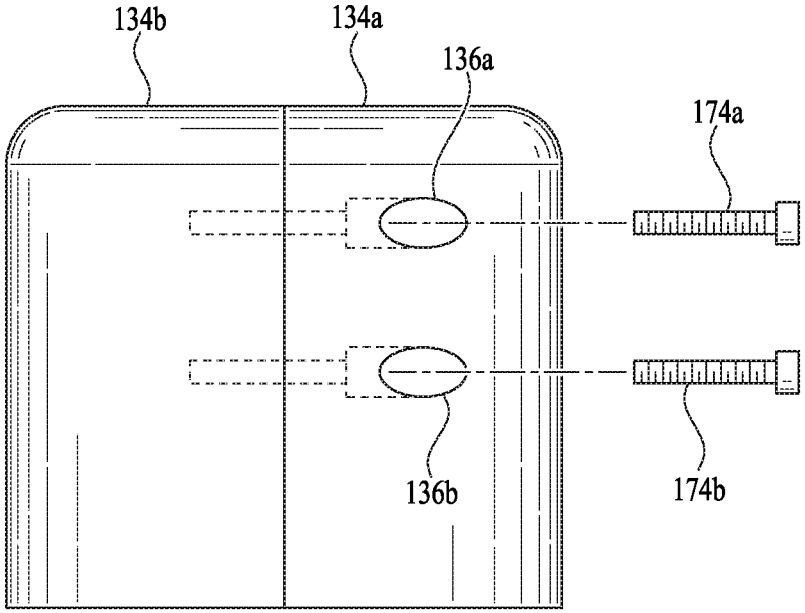
FIG. 2B is a side view of a shroud clamp according to an embodiment of the disclosure.

Turning to FIG. 2A and FIG. 2B, further details of the shroud clamp 134 are described. In an embodiment, the shroud clamp 134 comprises a first clamp section 134*a* and a second clamp section 134*b* which may be assembled around the production tubing 120, threadedly coupled to the upper shroud body 132 or to the shroud inlet 130, and bolted in place by bolts 174*a*, 174*b* positioned through bolt holes 136*a*, 136*b*. The view in FIG. 2B shows one side of the assembled shroud clamp 134. An opposite side of the shroud clamp 134 may comprise like bolt holes 136 and bolts 174 to secure the shroud clamp 134 to the production tubing 120. In an embodiment, the shroud clamp 134 defines a plurality of gas ports 172 that are located proximate to a center of the shroud clamp 134 that provide an escape path for gas bubbles and/or free gas. While four apertures, holes, or ports 172 are illustrated in FIG. 2A, in an embodiment, the shroud clamp 134 may provide one port 172, two ports 172, three ports 172, or more than four ports 172. Ports 172 may also be referred to as gas ports in some contexts.

Figure 2C:
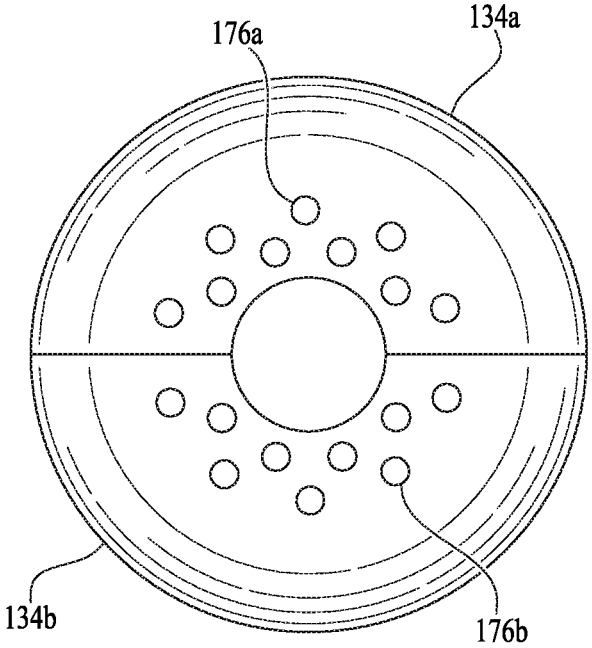
FIG. 2C is an illustration of another shroud clamp according to an embodiment of the disclosure.

Turning now to FIG. 2C, an alternative embodiment of the shroud clamp 134 is described. In an embodiment, the shroud clamp 134 defines a plurality of apertures, holes, or ports 176 in an upper or downstream part of the shroud clamp 134, for example one or more ports 176*a* in the first clamp section 134*a* and one or more ports 176*b* in the second clamp section 134*b*. Ports 176 may also be referred to as gas ports in some contexts. In an embodiment, the ports 176 may be concentrated radially closer to the center axis (i.e., an axis substantially concentric with the lateral axis of the production tubing 120) of the shroud clamp 134, because the high GVF reservoir fluid 142 in the interior of the inverted shroud assembly 122 may be concentrated proximate the outside of the production tubing 120 by the action of the directing vanes of the shroud inlet 130. In an embodiment, the shroud clamp 134 may comprise both ports 172 and ports 176.

Figure 3A:
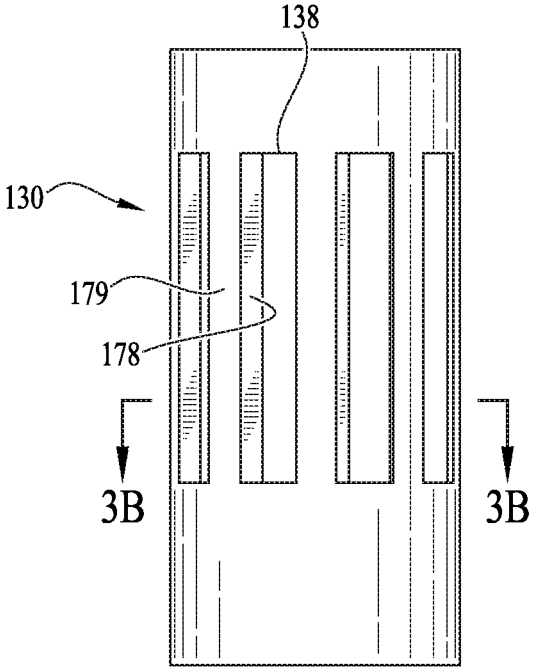
FIG. 3A is an illustration of a shroud inlet according to an embodiment of the disclosure.
Figure 3B:
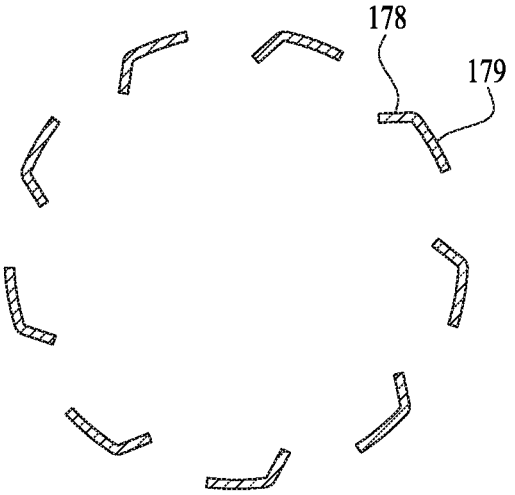
FIG. 3B is a cross-section illustration of the shroud inlet according to an embodiment of the disclosure.

Turning now to FIG. 3A and FIG. 3B, further details of the shroud inlet 130 are described. The shroud inlet 130 defines directing vanes 178 that deflect inwards from an outside diameter of the shroud inlet 130. The directing vanes 178 may be coupled to or integrated with members 179. As best seen in the cross-section view of FIG. 3B, the members 179 are coincident with the cylinder of the shroud inlet 130 while the directing vanes 178 deflect inwards. As reservoir fluid 142 enters the openings 138 in the shroud inlet 130, the directing vanes 178 may impart a rotational motion to the in-flowing reservoir fluid 142. This rotational motion may tend to separate the reservoir fluid 142 into a high GVF fluid close to a longitudinal axis of the production tubing 120 in the inverted shroud assembly 122 (close to the outside diameter of the production tubing 120) and a low gas-to-liquid fluid close to an inside surface of the inverted shroud assembly 122. The high GVF fluid may rise and escape through the ports 172, 176 in the shroud clamp 134. The low GVF fluid may flow to the pump intake 114 and be lifted to the wellhead 101 by the centrifugal pump 116.

Figure 3C:
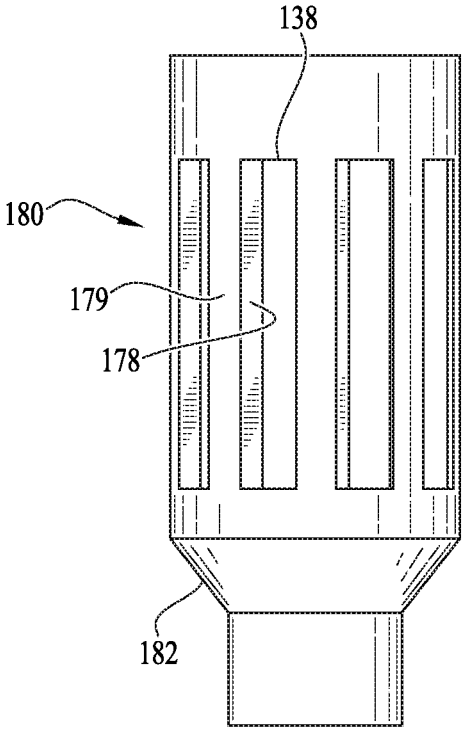
FIG. 3C is an illustration of another shroud inlet according to an embodiment of the disclosure.

Turning now to FIG. 3C, an alternative configuration of the shroud inlet 134 is described. Shroud inlet 180 is substantially similar to shroud inlet 134 described above, with the difference that it incorporates an outward taper section 182. In an embodiment, the inverted shroud assembly 122 does not comprise the outward taper section 128 or the inward taper section 129, and instead comprises the shroud inlet 180 that incorporates the outward taper section 182. In an embodiment, a benefit may be conferred by having the outward taper section 182 located as close as possible to the openings 138 in the shroud inlet 180, in order to promote the bubbling out of gas in suspension in the reservoir fluid 142 just as it enters the shroud inlet 180. In this case, the free gas or gas bubbles may more readily rise inside the inverted shroud assembly 122 and escape via the ports 172, 176 in the shroud clamp 134.

Figure 3D:
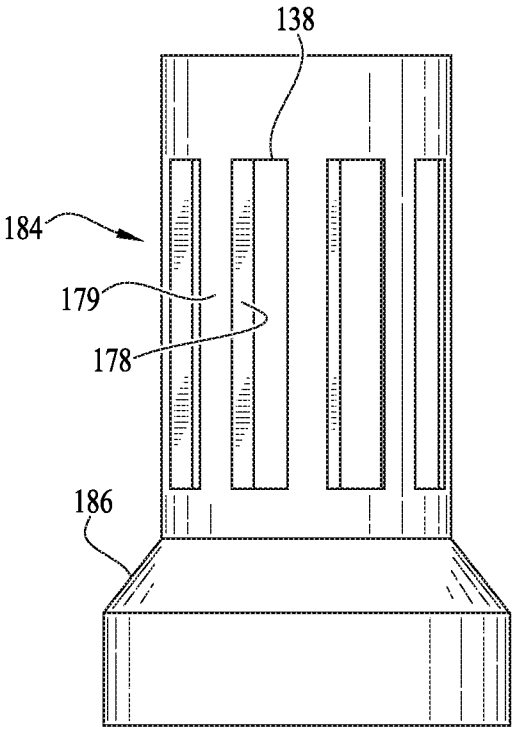
FIG. 3D is an illustration of yet another shroud inlet according to an embodiment of the disclosure.

Turning now to FIG. 3D, an alternative configuration of the shroud inlet 134 is described. Shroud inlet 184 is substantially similar to shroud inlet 134 described above, with the difference that it incorporates an inward taper section 186. In an embodiment, the inverted shroud assembly 122 does not comprise the outward taper section 128 or the inward taper section 129, and instead comprises the shroud inlet 184 that incorporates the inward taper section 186. In an embodiment, a benefit may be conferred by having the inward taper section 186 located as close as possible to the openings 138 in the shroud inlet 184, in order to promote slowing of the velocity of the reservoir fluid 142 as close as possible to the openings 138, whereby to allow the slower velocity of reservoir fluid 142 to allow gas bubbles to rise and escape into the wellbore 102 and/or to escape via the ports 172, 176.

Figure 4:
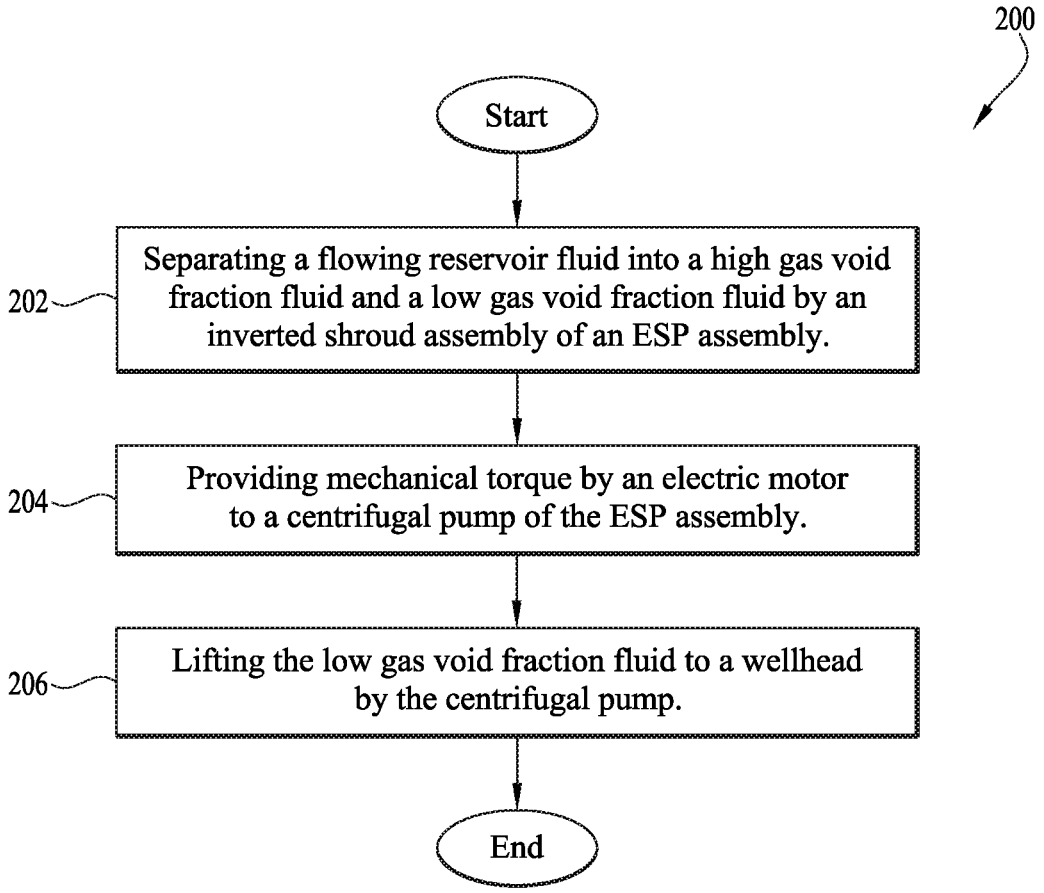
FIG. 4 is a flow chart of a method according to an embodiment of the disclosure.

Turning now to FIG. 4, a method 200 is described. In an embodiment, the method 200 is a method of artificially lifting fluid in a wellbore by an electric submersible pump (ESP) assembly, for example lifting reservoir fluid 142 by ESP assembly 106 comprising the inverted shroud assembly 122 described above. At block 202, the method 200 comprises separating a flowing reservoir fluid into a high gas void fraction (GVF) fluid and a low GVF fluid by an inverted shroud assembly of an ESP assembly. The inverted shroud assembly of method 200 may comprise any of the different embodiments of inverted shroud assemblies described above. The inverted shroud assembly of method 200 may comprise an outward taper section 128 without either a shroud clamp 134 having ports 172 or ports 176 (e.g., may comprise a shroud clamp that lacks such gas ports) or a shroud inlet having directing vanes 178. The inverted shroud assembly of method 200 may comprise an inward taper section 129 without either a shroud clamp 134 having ports 172 or ports 176 (e.g., may comprise a shroud clamp that lacks such gas ports) or a shroud inlet having directing vanes 178. The inverted shroud assembly of method 200 may comprise a shroud clamp having gas ports without either outward taper section 128, inward taper section 129, or a shroud inlet having directing vanes 178. The inverted shroud assembly of method 200 may comprise a shroud inlet having directing vanes 178 without either outward taper section 128, inward taper section 129, or shroud clamp 134 having gas ports. Alternatively, the inverted shroud assembly of method 200 may comprise a combination of two or more of these gas handling features.

In an embodiment, separating the flowing reservoir fluid into a high GVF fluid and a low GVF fluid comprises increasing a fluid velocity of the reservoir fluid by flowing the fluid past an outward taper of the inverted shroud assembly. This may be accomplished by flowing the reservoir fluid 142 past the outward taper section 128 in a first embodiment of the inverted shroud assembly 122 or by flowing the reservoir fluid 142 past the outward taper 182 of the shroud inlet 180 in a second embodiment of the inverted shroud assembly 122.

In an embodiment, separating the flowing reservoir fluid 142 into a high GVF fluid and a low GVF fluid comprises decreasing a fluid velocity of the reservoir fluid 142 by flowing the fluid past an inward taper of the inverted shroud assembly 122. This may be accomplished by flowing the reservoir fluid 142 past the inward taper section 129 in a third embodiment of the inverted shroud assembly 122 or by flowing the reservoir fluid 142 past the inward taper 186 of the shroud inlet 184 in a fourth embodiment of the inverted shroud assembly 122.

In an embodiment, separating the flowing reservoir fluid 142 into a high GVF fluid and a low GVF fluid comprises inducing a rotational movement in the reservoir fluid 142 by directing vanes 178 of the shroud inlet 130 of the inverted shroud assembly 122. In an embodiment, separating the flowing reservoir fluid 142 into a high GVF fluid and a low GVF fluid comprises exhausting gas bubbles or high GVF fluid out of a port 172, 176 in the shroud clamp 134 of the inverted shroud assembly 122 into a wellbore 102 above the ESP assembly 106.

At block 204, the method 200 comprises providing mechanical torque by an electric motor to a centrifugal pump of the ESP assembly. The processing of block 204 may be provided by the electric motor 110 providing mechanical torque to the centrifugal pump 116 via a drive shaft. At block 206, the method 200 comprises lifting the low GVF fluid to a wellhead by the centrifugal pump. In an embodiment, the processing of block 206 may be provided by the centrifugal pump 116 receiving reservoir fluid 142 via the pump intake 114 and pumping reservoir fluid 142 up the production tubing 120 to the wellhead 101 located at the surface 103. In an embodiment, the method 200 further comprises cooling the electric motor 110 by flowing reservoir fluid 142 over the outside surface of the electric motor 110, where the electric motor 110 is located below the seat plate 126 of the inverted shroud assembly 122.

Figure 5:
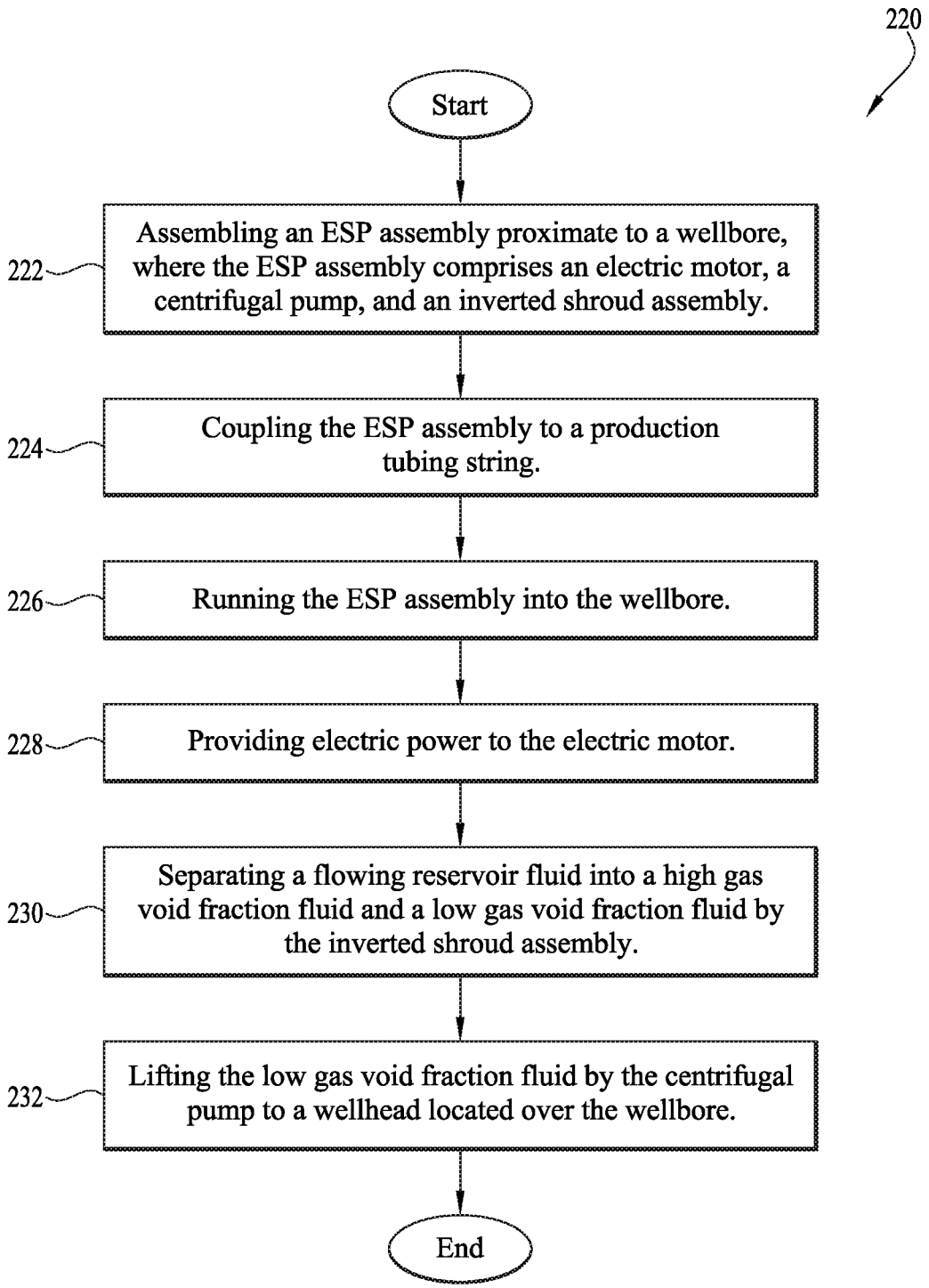
FIG. 5 is a flow chart of another method according to an embodiment of the disclosure.

Turning now to FIG. 5, a method 220 is described. In an embodiment, method 220 is a method of artificially lifting fluid in a wellbore by an electric submersible pump (ESP)

assembly. At block 222, the method 220 comprises assembling an ESP assembly proximate to a wellbore, where the ESP assembly comprises an electric motor, a centrifugal pump, and an inverted shroud assembly. The inverted shroud assembly of method 220 may comprise any of the different embodiments of inverted shroud assemblies described above. The inverted shroud assembly of method 220 may comprise an outward taper section 128 without either a shroud clamp 134 having ports 172 or ports 176 (e.g., may comprise a shroud clamp that lacks such gas ports) or a shroud inlet having directing vanes 178. The inverted shroud assembly of method 220 may comprise an inward taper section 129 without either a shroud clamp 134 having ports 172 or ports 176 (e.g., may comprise a shroud clamp that lacks such gas ports) or a shroud inlet 130, 180, 184 having directing vanes 178. The inverted shroud assembly of method 220 may comprise a shroud clamp having gas ports without either outward taper section 128, inward taper section 129, or a shroud inlet having directing vanes 178. The inverted shroud assembly of method 220 may comprise a shroud inlet 130, 180, 184 having directing vanes 178 without either outward taper section 128, inward taper section 129, or shroud clamp 134 having gas ports. Alternatively, the inverted shroud assembly of method 220 may comprise a combination of two or more of these gas handling features.

In an embodiment, assembling the ESP assembly 106 comprises assembling the inverted shroud assembly 122, where the inverted shroud assembly 122 comprises an outward taper section 128 below a shroud inlet 130 of the shroud assembly 122. In an embodiment, assembling the ESP assembly 106 comprises assembling the inverted shroud assembly 122, where the inverted shroud assembly 122 comprises an inward taper section 129 below a shroud inlet 130 of the shroud assembly 122. In an embodiment, assembling the ESP assembly 106 comprises assembling the inverted shroud assembly 122, where the inverted shroud assembly 122 comprises a shroud inlet 130, 180, 184 having directing vanes 178. In an embodiment, assembling the ESP assembly 106 comprises assembling the inverted shroud assembly 122, wherein assembling the inverted shroud assembly 122 comprises securing the inverted shroud assembly 122 to the production tubing 120 using a shroud clamp 134 that comprises ports 172, 176. For example, the shroud clamp 134 may be threadedly coupled to the shroud inlet 130, 180, 184 or to the upper shroud body 132, and the shroud clamp 134 may be secured to the production tubing 120 by bolting the first clamp section 134*a* to the second clamp section 134*b* with bolts 174.

At block 224, the method 220 comprises coupling the ESP assembly to a production tubing string. The processing of block 224 may comprise coupling the pump outlet 118 to the production tubing 120. The processing of block 224 may further comprise securing the shroud clamp 130 to the production tubing 120 as described above with reference to block 222. In an embodiment, the processing of block 222 and block 224 may overlap and intersect each other. At block 226, the method 220 comprises running the ESP assembly into the wellbore. At block 228, the method 220 comprises providing electric power to the electric motor.

At block 230, the method 220 comprises separating a flowing reservoir fluid into a high gas void fraction (GVF) fluid and a low GVF fluid by the inverted shroud assembly. At block 232, the method 220 comprises lifting the low GVF fluid by the centrifugal pump to a wellhead located over the wellbore.

Additional Disclosure

The following are non-limiting, specific embodiments in accordance with the present disclosure:

A first embodiment, which is an electric submersible pump (ESP) assembly, comprising an electric motor, a centrifugal pump mechanically coupled to the electric motor, and a gas handling inverted shroud assembly.

A second embodiment, which is the ESP assembly of the first embodiment, wherein the gas handling inverted shroud assembly comprises a lower shroud body located below a shroud inlet of the inverted shroud assembly having a taper section, where a first portion of the lower shroud body below the taper section has a first diameter and a second portion of the lower shroud body above the taper section has a second diameter that is different from the first diameter.

A third embodiment, which is the ESP assembly of the second embodiment, wherein the taper section is an outward taper section and the second diameter is greater than the first diameter.

A fourth embodiment, which is the ESP assembly of the second embodiment, wherein the taper section is an inward taper section and the second diameter is less than the first diameter.

A fifth embodiment, which is the ESP assembly of the first, the second, the third, or the fourth embodiment, wherein the gas handling inverted shroud assembly comprises a shroud inlet comprising directing vanes.

A sixth embodiment, which is the ESP assembly of the first, the second, the third, the fourth, or the fifth embodiment, wherein the gas handling inverted shroud assembly comprises a shroud clamp having ports.

A seventh embodiment, which is the ESP assembly of the first, the second, the third, the fourth, the fifth, or the sixth embodiment, wherein the gas handling inverted shroud assembly comprises an upper shroud body located above a shroud inlet of the inverted shroud assembly.

An eighth embodiment, which is the ESP assembly of the first, the fifth, the sixth, or the seventh embodiment, wherein the inverted shroud assembly comprises a shroud inlet having an outward taper below openings defined by the shroud inlet.

A ninth embodiment, which is the ESP assembly of the first, the fifth, the sixth, or the seventh embodiment, wherein the inverted shroud assembly comprises a shroud inlet having an inward taper below openings defined by the shroud inlet.

A tenth embodiment, which is a method of artificially lifting fluid in a wellbore by an electric submersible pump (ESP) assembly, comprising separating a flowing reservoir fluid into a high gas void fraction fluid and a low gas void fraction fluid by an inverted shroud assembly of an ESP assembly, providing mechanical torque by an electric motor to a centrifugal pump of the ESP assembly, and lifting the low gas void fraction fluid to a wellhead by the centrifugal pump.

An eleventh embodiment, which is the method of the tenth embodiment, wherein separating the flowing reservoir fluid into a high gas void fraction fluid and a low gas void fraction fluid comprises increasing a fluid velocity of the reservoir fluid by flowing the fluid past an outward taper of the inverted shroud assembly.

A twelfth embodiment, which is the method of the tenth embodiment, wherein separating the flowing reservoir fluid into a high gas void fraction fluid and a low gas void fraction fluid comprises decreasing a fluid velocity of the reservoir fluid by flowing the fluid past an inward taper of the inverted shroud assembly.

A thirteenth embodiment, which is the method of the tenth, the eleventh, or the twelfth embodiment, wherein separating the flowing reservoir fluid into a high gas void fraction fluid and a low gas void fraction fluid comprises inducing a rotational movement in the reservoir fluid by directing vanes of a shroud inlet of the inverted shroud assembly.

A fourteenth embodiment, which is the method of the tenth, the eleventh, the twelfth, or the thirteenth embodiment, wherein separating the flowing reservoir fluid into a high gas void fraction fluid and a low gas void fraction fluid comprises exhausting gas bubbles or high gas void fraction fluid out of a port in a shroud clamp of the inverted shroud assembly into a wellbore above the ESP assembly.

A fifteenth embodiment, which is the method of the tenth, the eleventh, the twelfth, the thirteenth, or the fourteenth embodiment, further comprising cooling the electric motor by flowing reservoir fluid over the outside surface of the electric motor, where the electric motor is located below a seat plate of the inverted shroud assembly.

A sixteenth embodiment, which a method of artificially lifting fluid in a wellbore by an electric submersible pump (ESP) assembly, comprising assembling an ESP assembly proximate to a wellbore, where the ESP assembly comprises an electric motor, a centrifugal pump, and an inverted shroud assembly, coupling the ESP assembly to a production tubing string, running the ESP assembly into the wellbore, providing electric power to the electric motor, separating a flowing reservoir fluid into a high gas void fraction fluid and a low gas void fraction fluid by the inverted shroud assembly, and lifting the low gas void fraction fluid by the centrifugal pump to a wellhead located over the wellbore.

A seventeenth embodiment, which is the method of the sixteenth embodiment, wherein assembling the ESP assembly comprises assembling the inverted shroud assembly, where the inverted shroud assembly comprises an outward taper section below a shroud inlet of the shroud assembly.

An eighteenth embodiment, which is the method of the sixteenth embodiment, wherein assembling the ESP assembly comprises assembling the inverted shroud assembly, where the inverted shroud assembly comprises an inward taper section below a shroud inlet of the shroud assembly.

A nineteenth embodiment, which is the method of the sixteenth, the seventeenth, or the eighteenth embodiment, wherein assembling the ESP assembly comprises assembling the inverted shroud assembly, where the inverted shroud assembly comprises a shroud inlet having directing vanes.

A twentieth embodiment, which is the method of the sixteenth, the seventeenth, the eighteenth, or the nineteenth embodiment, wherein assembling the ESP assembly comprises assembling the inverted shroud assembly, wherein assembling the inverted shroud assembly comprises securing the inverted shroud assembly to a production tubing using a shroud clamp that comprises ports.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) assembly, comprising:

an electric motor;

a centrifugal pump mechanically coupled to the electric motor; and a gas handling inverted shroud assembly comprising a shroud inlet and a lower shroud body comprising a first tubing having a first diameter, a taper section coupled to the first tubing above the first tubing that has a diameter that transitions between the first diameter and a second diameter, wherein the second diameter is different from the first diameter, and a second tubing having the second diameter coupled to the taper section above the taper section and coupled to the shroud inlet.

2. The ESP assembly of claim 1, wherein the taper section is an outward taper section and the second diameter is greater than the first diameter.

3. The ESP assembly of claim 1, wherein the taper section is an inward taper section and the second diameter is less than the first diameter.

4. The ESP assembly of claim 1, wherein the shroud inlet comprises directing vanes that are integrated with the shroud inlet.

5. The ESP assembly of claim 1, wherein the gas handling inverted shroud assembly comprises a shroud clamp having ports.

6. The ESP assembly of claim 1, wherein the gas handling inverted shroud assembly comprises an upper shroud body tubing located above the shroud inlet of the inverted shroud assembly.

7. An electric submersible pump (ESP) assembly, comprising:

an electric motor;

a centrifugal pump mechanically coupled to the electric motor; and a gas handling inverted shroud assembly, wherein the inverted shroud assembly comprises a shroud inlet having an inward taper below openings defined by the shroud inlet.

8. A method of artificially lifting fluid in a wellbore by an electric submersible pump (ESP) assembly, comprising:

separating a flowing reservoir fluid into a high gas void fraction fluid and a low gas void fraction fluid by inducing a rotational movement in the reservoir fluid by directing vanes of a shroud inlet of an inverted shroud assembly of an ESP assembly, wherein the directing vanes are integrated with the shroud inlet;

providing mechanical torque by an electric motor to a centrifugal pump of the ESP assembly; and lifting the low gas void fraction fluid to a wellhead by the centrifugal pump.

9. The method of claim 8, wherein separating the flowing reservoir fluid into a high gas void fraction fluid and a low gas void fraction fluid comprises increasing a fluid velocity of the reservoir fluid by flowing the fluid past an outward taper of the inverted shroud assembly.

10. The method of claim 8, wherein separating the flowing reservoir fluid into a high gas void fraction fluid and a low gas void fraction fluid comprises decreasing a fluid velocity of the reservoir fluid by flowing the fluid past an inward taper of the inverted shroud assembly.

11. The method of claim 8, further comprising cooling the electric motor by flowing reservoir fluid over the outside surface of the electric motor, where the electric motor is located below a seat plate of the inverted shroud assembly.

12. A method of artificially lifting fluid in a wellbore by an electric submersible pump (ESP) assembly, comprising:

separating a flowing reservoir fluid into a high gas void fraction fluid and a low gas void fraction fluid by an inverted shroud assembly of an ESP assembly, wherein separating the flowing reservoir fluid into a high gas void fraction fluid and a low gas void fraction fluid comprises exhausting gas bubbles or high gas void fraction fluid out of a port in a shroud clamp of the inverted shroud assembly into a wellbore above the ESP assembly;

providing mechanical torque by an electric motor to a centrifugal pump of the ESP assembly; and lifting the low gas void fraction fluid to a wellhead by the centrifugal pump.

13. The method of claim 12, wherein the inverted shroud assembly comprises an upper shroud body comprising a tubing and coupled at an upper end to the shroud clamp, wherein exhausting gas bubbles or high gas void fraction fluid out of the ports in the shroud clamp avoids recirculating the gas bubbles or high gas void fraction fluid into the shroud inlet.

14. A method of artificially lifting fluid in a wellbore by an electric submersible pump (ESP) assembly, comprising:

assembling an ESP assembly proximate to a wellbore, where the ESP assembly comprises an electric motor, a centrifugal pump, and an inverted shroud assembly;

coupling the ESP assembly to a production tubing string by securing the inverted shroud assembly to the production tubing string using a shroud clamp, wherein the shroud clamp defines ports in an upper part of the shroud clamp;

running the ESP assembly into the wellbore;

providing electric power to the electric motor;

separating a flowing reservoir fluid into a high gas void fraction fluid and a low gas void fraction fluid by the inverted shroud assembly, wherein gas of the high gas void fraction is provided an escape path by the ports in the upper part of the shroud clamp; and lifting the low gas void fraction fluid by the centrifugal pump to a wellhead located over the wellbore.

15. The method of claim 14, wherein assembling the ESP assembly comprises assembling the inverted shroud assembly, where the inverted shroud assembly comprises an outward taper section below a shroud inlet of the shroud assembly.

16. The method of claim 14, wherein assembling the ESP assembly comprises assembling the inverted shroud assembly, where the inverted shroud assembly comprises an inward taper section below a shroud inlet of the shroud assembly.

17. The method of claim 14, wherein assembling the ESP assembly comprises assembling the inverted shroud assembly, where the inverted shroud assembly comprises a shroud inlet having directing vanes that are integrated with the shroud inlet.

18. The method of claim 14, wherein the inverted shroud assembly comprises a shroud inlet that has an outward taper below openings defined by the shroud inlet, wherein the openings are axially aligned with a centerline of the shroud inlet and are parallel to each other.

19. The method of claim 14, wherein the inverted shroud assembly comprises a shroud inlet that has an inward taper below openings defined by the shroud inlet, wherein the openings are axially aligned with a centerline of the shroud inlet and are parallel to each other.

20. The method of claim 14, wherein the inverted shroud assembly comprises an upper shroud body comprising a tubing and coupled at an upper end to the shroud clamp.

* * * * *